US007631987B2

(12) United States Patent
Wei

(10) Patent No.: US 7,631,987 B2
(45) Date of Patent: Dec. 15, 2009

(54) LIGHT EMITTING DIODE LAMP

(75) Inventor: Wen-Chen Wei, Taipei Hsien (TW)

(73) Assignee: Neng Tyi Precision Industries Co., Ltd., Taipei Hsien (TW)

( * ) Notice: Subject to any disclaimer, the term of this patent is extended or adjusted under 35 U.S.C. 154(b) by 103 days.

(21) Appl. No.: 12/076,131

(22) Filed: Mar. 14, 2008

(65) Prior Publication Data

US 2009/0189169 A1 Jul. 30, 2009

(30) Foreign Application Priority Data

Jan. 28, 2008 (TW) ..... 97201817 U

(51) Int. Cl.
*F21V 29/00* (2006.01)

(52) U.S. Cl. ..... 362/294; 362/373; 361/703

(58) Field of Classification Search ..... 362/294, 362/373; 361/701, 702, 703
See application file for complete search history.

(56) References Cited

U.S. PATENT DOCUMENTS 7,396,146 B2 * 7/2008 Wang ..... 362/294
2009/0040759 A1 * 2/2009 Zhang et al. ..... 362/249

* cited by examiner

*Primary Examiner*—John A Ward
(74) *Attorney, Agent, or Firm*—Rosenberg, Klein & Lee

(57) ABSTRACT

A light emitting diode lamp includes a heat sink, a socket, a light emitting module, a holder and a lens. The socket and the holder are respectively positioned opposite sides of the heat sink. The light emitting module is combined with the heat sink and has a light emitting diode unit. The lens is mounted on the light emitting diode unit and combined inside the holder. The heat sink includes a substrate and a plurality of heat dissipating fins. The substrate has a plurality of extending arms in a manner that a slot is formed between two neighboring extending arms. A plurality of heat dissipating fins is inserted into the corresponding slots. One of opposite sidewall surfaces of each extending arm is against one of opposite surfaces of each heat dissipating fin. Thereby, there is no need of producing a heat sink by soldering.

10 Claims, 6 Drawing Sheets

LIGHT EMITTING DIODE LAMP

BACKGROUND OF THE INVENTION

1. Field of the Invention

The invention generally relates to a light emitting diode lamp, especially to a light emitting diode lamp which meets the MR-16 specification and effectively dissipates the heat from the light emitting diode lamp 2. Description of the Related Art As the progress of the technology development, the light emitting diode units have been applied to the illumination field. In addition, because of its small volume, low power consumption and long service life, the light emitting diode units have been used in traffic lights, flashlights and lamps.

A conventional light emitting diode lamp is usually disposed with a heat sink to dissipate the heat from the light emitting diode unit. The heat sink is mounted to a plurality of heat dissipating fins by soldering. The heat dissipating fins are made of thermally conductive metal, especially aluminum which is featured as light weight and good heat dissipating performance. Therefore, the heat sink with soldered heat dissipating fins has been widely used.

However, the aluminum fins must be coated with chemical nickel before soldering, which increases the production cost, with more complicate production and longer work hours.

Furthermore, since the heat dissipating fins must be soldered, loss in heat conduction occurs due to the difference of heat conduction coefficient between the solder and the heat dissipating fins, resulting in poor heat dissipation.

Therefore, there is a need of a heat sink which can overcome the above problems.

SUMMARY OF THE INVENTION

An object of the invention is to provide a light emitting diode lamp which is made more economically and efficiently dissipates the heat from the light emitting diode lamp.

In order to achieve the above and other objectives, the light emitting diode lamp of the invention includes:

a heat sink, comprising a substrate and a plurality of extending arms, a slot being formed between two neighboring extending arms; and a plurality of heat dissipating fins, inserted into the corresponding slots, one of opposite sidewall surfaces of each extending arm being against one of opposite surfaces of each heat dissipating fin, each heat dissipating fin has a fin top and a fin bottom respectively protruding from a top and a bottom of the substrate, the heat dissipating fin and the top of the substrate forming an accommodation space;

a socket, firmly fixed at the fin bottoms of the heat dissipating fins;

a light emitting module, comprising:

a heat conductor, mounted on the substrate of the heat sink;

at least one light emitting diode unit, mounted on the heat conductor;

a circuit board, electrically connected to the light emitting module; and two pins, electrically connected to the circuit board, wherein the two pins penetrate through the socket;

a holder, inside the accommodation space opposite to the socket, and the heat dissipating fins are secured to the holder; and a lens, positioned above the light emitting diode unit and assembled inside the holder.

The invention provides the following advantages. Riveting the heat dissipating fins with the substrate together helps the heat dissipating fins be secured by means of urging the opposite sidewall surfaces of each extending arm against the opposite surfaces of each heat dissipating fin. In addition, there is no need of soldering nickel on the heat dissipating fins and no solder is needed as well. Therefore, the production cost and shortened labor hours can be reduced, while loss of heat conduction can be avoided.

To provide a further understanding of the invention, the following detailed description illustrates embodiments and examples of the invention, this detailed description being provided only for illustration of the invention.

DETAILED DESCRIPTION OF THE EMBODIMENTS

Figure 1:
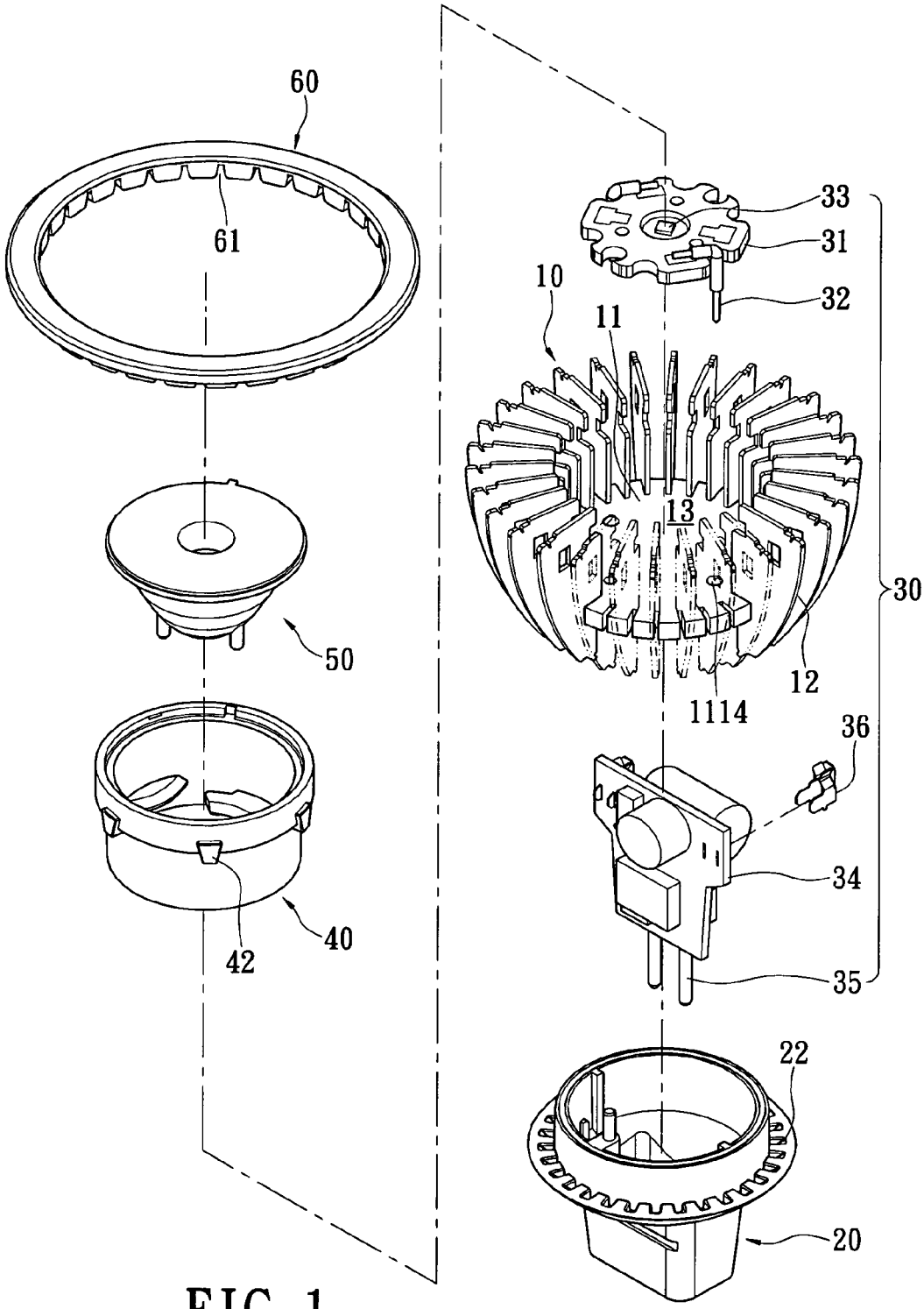
FIG. 1 is an exploded view of a light emitting diode lamp according to one embodiment of the invention.

Wherever possible in the following description, like reference numerals will refer to like elements and parts unless otherwise illustrated.

Referring to FIG. 1 through FIG. 5, a light emitting diode lamp according to one embodiment of the invention includes a heat sink 10, a socket 20, a light emitting module 30, a holder 40, a lens 50 and a protection ring 60.

Figure 2:
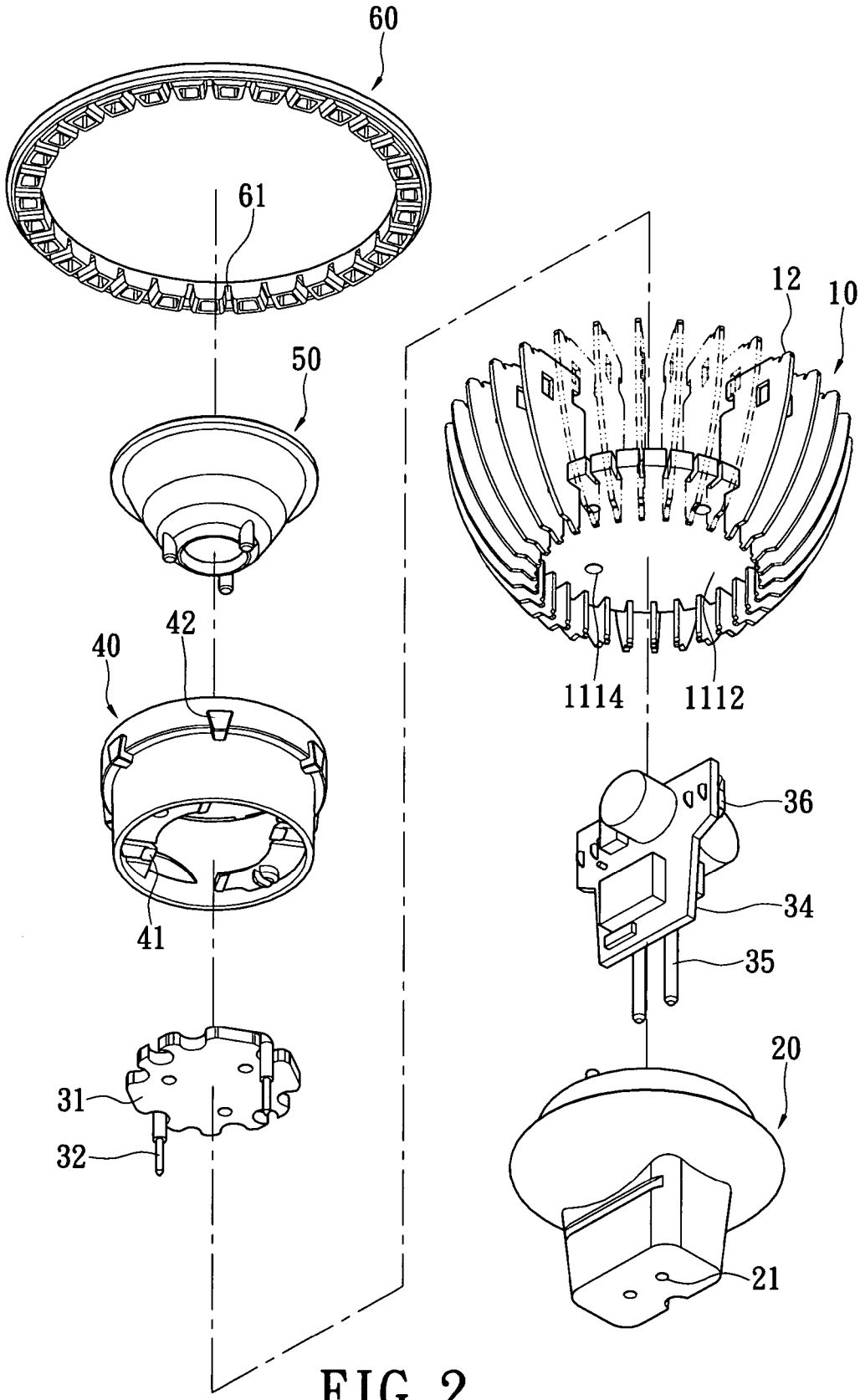
FIG. 2 is an exploded view of a light emitting diode lamp from another angle of view according to one embodiment of the invention.
Figure 4:
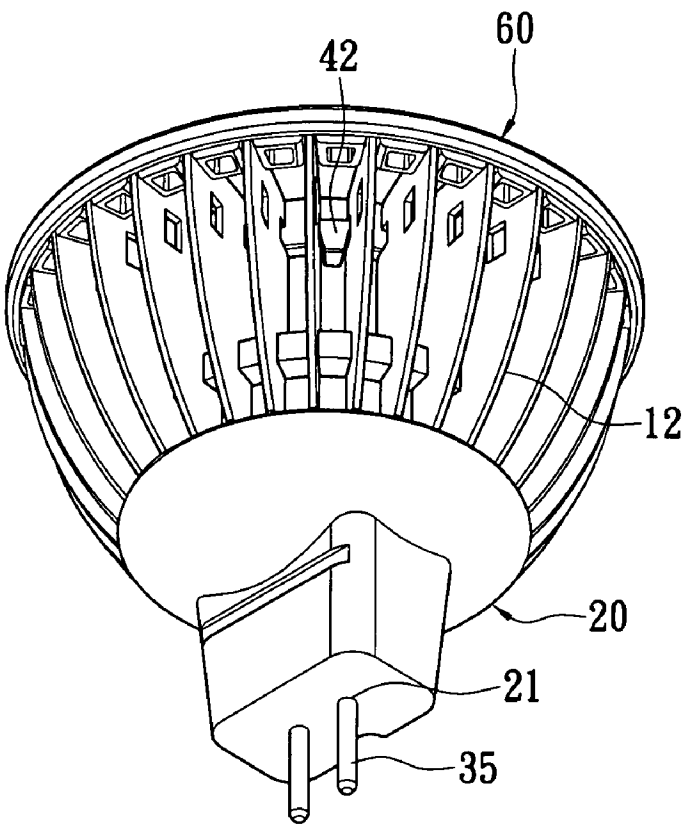
FIG. 4 is a perspective view of a light emitting diode from another angle of view according to one embodiment of the invention.
Figure 3:
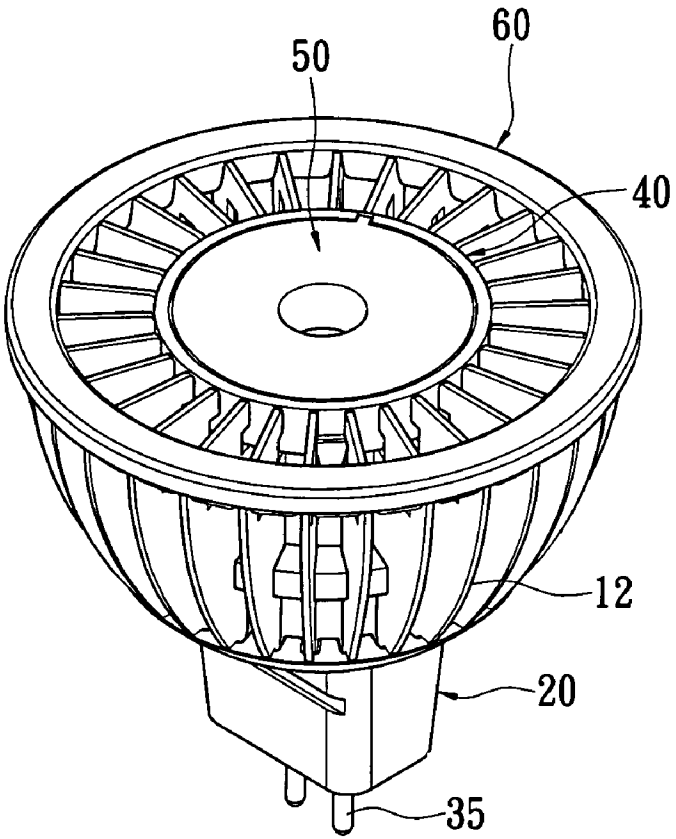
FIG. 3 is a perspective view of a light emitting diode lamp according to one embodiment of the invention.
Figure 6:
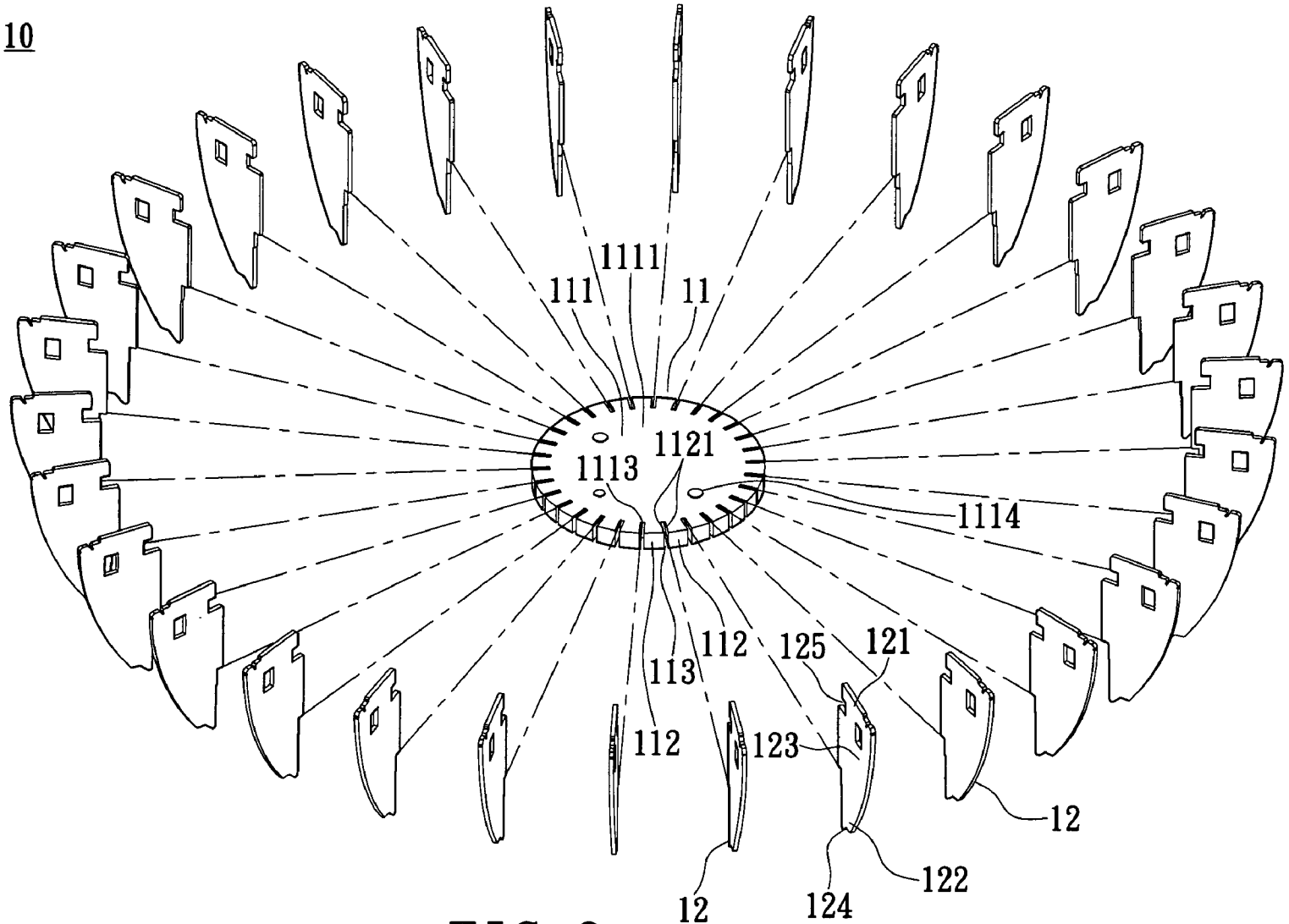
FIG. 6 is an exploded view of a heat sink of a light emitting diode lamp according to one embodiment.

Referring to FIG. 6, the heat sink 10 includes a substrate 11 and a plurality of heat dissipating fins 12. The substrate 11 includes a base 111 and a plurality of extending arms 112. The base 111 can be a round plate or a polygonal plate, for example. In the embodiment as shown, the base 111 is a round plate. The base 111 has a top 1111, a bottom 1112 (as shown in FIG. 2), side walls 1113, and trough holes 1114 penetrating through the top 1111 and the bottom 1112.

The extending arms 112 are positioned at intervals from the side walls 1113 of the base 111. A slot 113 is formed between two neighboring extending arms 112.

Figure 5:
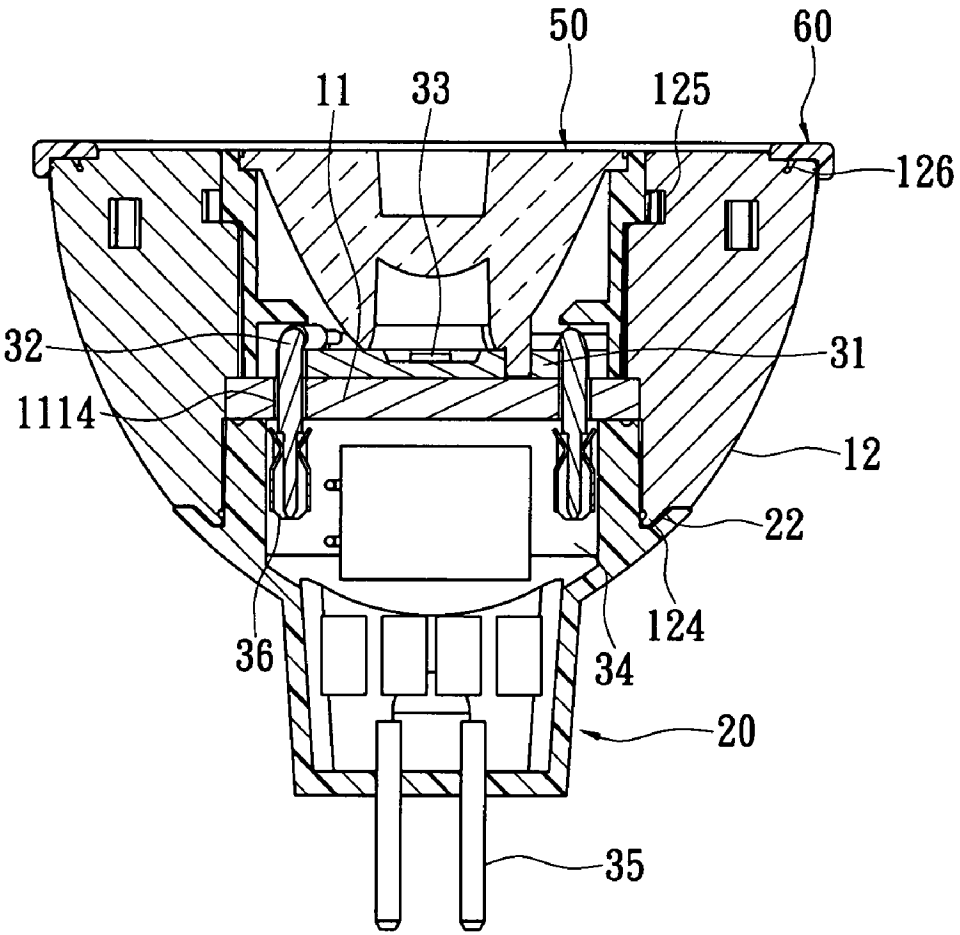
FIG. 5 is a cross-sectional view of a light emitting diode lamp according to one embodiment of the invention.

Each heat dissipating fin 12 can be polygonal plate or a round plate (not shown). Each heat dissipating fin 12 has a fin top 121 and a fin bottom 122 opposite to the fin top 121, and has opposite surfaces 123. The fin bottoms 122 of the heat dissipating fins 12 respectively extend in a downward slant direction to form corresponding insertion parts 124 (as shown in FIG. 5). A plurality of recesses 125 are formed on the base 111 of the substrate 11 close to the fin top.

Each heat dissipating fin 12 is inserted into the corresponding slot 113. One of opposite sidewall surfaces 1121 of each extending arm 112 is against one of opposite surfaces 123 of each heat dissipating fin 12 in a manner to secure each heat dissipating fin 12. The fin top 121 and the fin bottom 122 of each heat dissipating fin 12 respectively stretch out of the top and the bottom of the substrate 11 in a manner to arrange the heat dissipating fins 12 in circle around the substrate 11, as shown in FIG. 1. The heat dissipating fins 12 and the substrate 11 form an accommodation space 13 as shown in FIG. 1.

In this embodiment, each heat dissipating fin 12 is riveted with the substrate 11 so that the combination of the heat dissipating fin 12 and the substrate 11 is pressed down against each extending arm 112 and therefore against the surface 123 of the corresponding heat dissipating fin 12.

Figure 7:
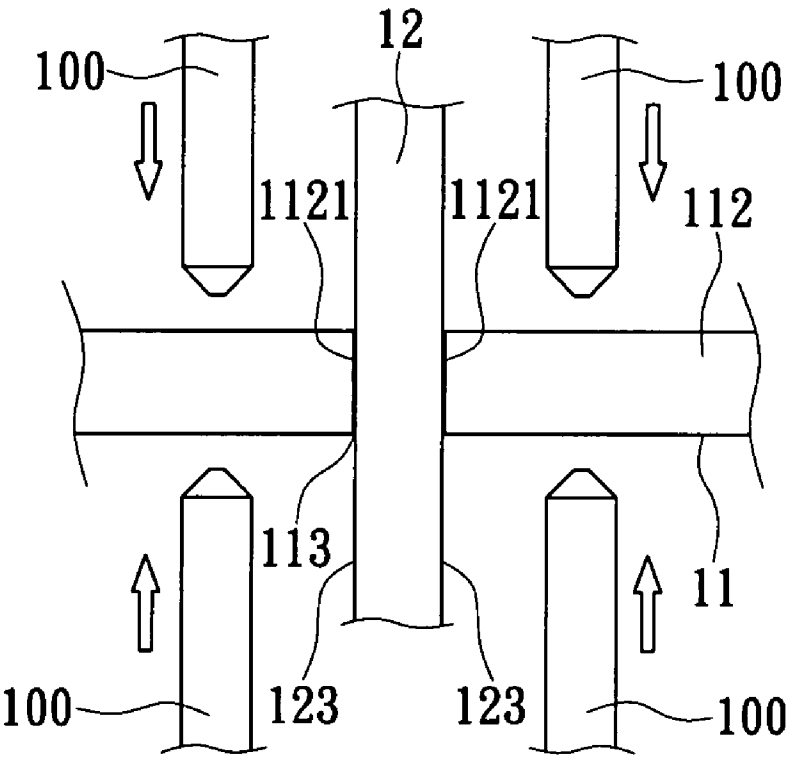
FIG. 7 is a schematic view of knife edges forced face-to-face against onto the corresponding extending arm until the extending arm is resiliently deformed according to one embodiment of the invention.

Referring to FIG. 7, the riveting can be achieved by forcing a plurality of knife edges face-to-face against onto a top and a bottom of the corresponding extending arm 112 until the extending arm 112 is resiliently deformed. The sidewall surfaces 1121 of each extending arm 112 thereby are forced against the surface 123 of the corresponding heat dissipating fin 12.

The socket 20 is a hollow casing which has two holes 21 at its bottom as shown in FIG. 2 and a plurality of inserting sockets 22 as shown in FIG. 1. The insertion parts 124 of the fin bottoms 122 of the heat dissipating fins 12 are respectively inserted into the corresponding inserting sockets 22 as shown in FIG. 5, so that the socket 20 is firmly fixed at the fin bottoms 122 of the heat dissipating fins 12.

The light emitting module 30 includes a heat conductor 31, at least one light emitting diode unit 33, a circuit board 34 and two pins 35. The heat conductor 31 is attached on the top of the heat sink 10 of the substrate 11. A heat dissipating media such as a heat dissipating paste can be further applied between the heat conductor 31 and the substrate 11 to further enhance the heat dissipation. The heat conductor 31 is electrically connected to leads 32 which respectively correspond to the through holes 1114 of the base 11, as shown in FIG. 1.

The light emitting diode unit 33 is disposed on the heat conductor 31 through which the heat generated by the light emitting diode unit 33 is conducted to the substrate 11 and the heat dissipating fins 12. Air circulated among these heat dissipating fins 12 cools down the heat. A gel such as epoxy resin can be filled between the light emitting diode unit 33 and the heat conductor 31 to prevent any short circuit.

The circuit board 34 has wire routing for voltage conversion. The circuit board 34 has two fixtures 36 as shown in FIG. 1. The two leads 32 of the heat conductor 31 penetrate through the through holes 1114 of the base 111 to reach the corresponding fixtures 36 as shown in FIG. 5. Thereby, the circuit board 34 is electrically connected to the light emitting diode unit 33 on the heat conductor 31.

The circuit board 34 in this embodiment can be received inside the socket 20. However, the location of the circuit board 34 is not limited to inside the socket 20. For example, the circuit board 34 can be located in the accommodation space 13 of the heat sink 10 and electrically connected to the light emitting diode unit 33 in other manner. Furthermore, a gel can be filled between the circuit board 34 and the socket 20 to prevent the circuit board 34 from being damaged and wet.

The pins 35 are electrically connected to the circuit board 34, and penetrate through the holes 21 of the heat set 20. The circuit board 34 and the pins 35 comply with the requirements of MR-16 specification. The pins 35 are used to connect the circuit to an external power socket. The circuit board 34 converts the external power so as to provide the power needed for the light emitting diode unit 33.

The holder 40 can be a hollow casing which has two pressing arms 41 as shown in FIG. 2. The pressing arm 41 push the top of the heat conductor 31 to be against the top of the substrate 11 in order to further confirm the heat conducting path.

The holder 40 is received in the accommodation space 13 opposite to the socket 20. The holder 40 has a plurality of engaging parts 42 along its periphery. The engaging parts 42 are of tapering shape which taper from its top toward its bottom and thus have slant sides. The engaging parts 42 of the holder 40 respectively engage with corresponding recesses 125 of the heat dissipating fins 12 so that the heat dissipating fins 12 are secured to the holder 40.

When the holder 40 is placed into the accommodation space 13 of the heat sink 10, the fin tops 121 are resiliently deformed by the slant sides of the engaging parts 42. After the engaging parts 42 enter into the corresponding recesses 125, the fin tops 121 returns to its original positions.

A gel such as epoxy resin can be filled between the holder 40 and the heat dissipating fins 12 to enhance the bonding between the holder 40 and the heat dissipating fins 12 and offer water-proof effect.

The lens 50 can be made of transparent material, with a thickness reducing from its center to its periphery. The lens 50 is positioned inside the holder 40, above the light emitting diode unit 33 so that the light beams from the light emitting diode unit 33 can be efficiently transmitted to a wide range.

The protection ring 60 is a hollow ring having a plurality of grooves 61 at its bottom to receive corresponding fin tops 121 of the heat dissipating fins 12. The protection ring 60 thereby sleeves the heat dissipating fins 12 from the top of the heat dissipating fins 12.

Each heat dissipating fin 12 can be further formed with a filling groove 126 on the fin top 121 thereof as shown in FIG. 5. The filling groove 126 is filled with the gel. The protection ring 60 is adhered onto the fin tops 121 of the heat dissipating fins 12 to enhance the binding between the protection ring 60 and the heat dissipating fins 12 and prevent the heat dissipating fins 12 from being shifted. The user may directly hold the protection ring 60 if the light emitting diode unit needs to be replaced or installed.

Therefore, in the light emitting diode according to the invention, the slot 113 of each extending arm 112 is used to receive the heat dissipating fin 12. By means of urging the opposite sidewall surfaces 1121 of each extending arm 112 against the opposite surfaces 123 of each heat dissipating fin 12, the heat dissipating fin 12 can be firmly secured. Compared to prior art having soldered heat dissipating fins, the light emitting diode lamp according the invention can be achieved with lowered production cost, less labor hours and simplified production procedure, while without using the electrically nickel plating.

Furthermore, the light emitting diode lamp according to the invention does not use solders which helps prevent any loss in thermal conduction. Failure of using lead-containing or no-lead solders which either contain lead or contribute to environmental protection. In addition, configures of the heat dissipating fins have improved heat dissipating performance.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A light emitting diode lamp, comprising a heat sink, comprising a substrate and a plurality of extending arms, a slot is formed between two neighboring extending arms; and a plurality of heat dissipating fins, inserting into the corresponding slots, one of opposite sidewall surfaces of each extending arm being against one of opposite surfaces of each heat dissipating fin, each heat dissipating fin has a fin top and a fin bottom respectively protruding from a top and a bottom of the substrate, the heat dissipating fin and the top of the substrate forming an accommodation space;

a socket, firmly fixed at the fin bottoms of the heat dissipating fins;

a light emitting module, comprising:

a heat conductor, mounted on the substrate of the heat sink;

at least one light emitting diode unit, mounted on the heat conductor;

a circuit board, electrically connected to the light emitting module; and two pins, electrically connected to the circuit board, wherein the two pins penetrate through the socket;

a holder, inside the accommodation space opposite to the socket, and the heat dissipating fins are secured to the holder; and a lens, positioned above the light emitting diode unit and assembled inside the holder.

2. The light emitting diode lamp of claim 1, wherein each heat dissipating fin is riveted with the substrate so that the combination of the heat dissipating fin and the base presses against each extending arm of the substrate and therefore against the surface of the corresponding heat dissipating fin.

3. The light emitting diode lamp of claim 2, wherein the riveting is achieved by forcing a plurality of knife edges face-to-face against onto a top and a bottom of the corresponding extending arm until the extending arm is resiliently deformed, so that the sidewall surfaces of each extending arm thereby are forced against the surface of the corresponding heat dissipating fin.

4. The light emitting diode lamp of claim 1, wherein the fin bottoms of the heat dissipating fins respectively extend in a downward slant direction to form corresponding insertion parts, a plurality of inserting sockets being positioned around a periphery of the socket, and the insertion parts being respectively inserted into the corresponding inserting sockets.

5. The light emitting diode lamp of claim 1, wherein the substrate has two through holes, the heat conductor being electrically connected to leads, the circuit board having two fixtures, the two leads of the heat conductor penetrating through the through holes of the substrate to reach the corresponding fixtures, thereby the circuit board being electrically connected to the light emitting diode unit on the heat conductor.

6. The light emitting diode lamp of claim 1, wherein the socket is hollow and has the circuit board inside.

7. The light emitting diode lamp of claim 1, wherein the holder is hollow casing and has two pressing arms, the pressing arm pushing the top of the heat conductor to be against the top of the base.

8. The light emitting diode lamp of claim 1, wherein the holder has a plurality of engaging parts along its periphery, and the heat dissipating fins respectively have recesses close to one side of the base of the substrate so that the heat dissipating fins are secured to the holder.

9. The light emitting diode lamp of claim 1, further comprising a protection ring having a plurality of grooves at its bottom to receive corresponding fin tops of the heat dissipating fins.

10. The light emitting diode lamp of claim 9, wherein each heat dissipating fin is further formed with a filling groove on the fin top thereof for filling with the gel so that the protection ring is adhered onto the fin tops of the heat dissipating fins.

* * * * *